US009617689B2

(12) United States Patent
Atmur et al.

(10) Patent No.: US 9,617,689 B2
(45) Date of Patent: Apr. 11, 2017

(54) PASSIVE SWITCH FOR A RAILWAY TRACK

(71) Applicant: The Boeing Company, Chicago, IL (US)

(72) Inventors: Robert J. Atmur, Whittier, CA (US); Thorin Arthur Rogers, Long Beach, CA (US)

(73) Assignee: The Boeing Company, Chicago, IL (US)

( * ) Notice: Subject to any disclaimer, the term of this patent is extended or adjusted under 35 U.S.C. 154(b) by 207 days.

(21) Appl. No.: 14/551,504

(22) Filed: Nov. 24, 2014

(65) Prior Publication Data

US 2016/0144874 A1 May 26, 2016

(51) Int. Cl.

| | |
|---|---|
| ***E01B 7/10*** | (2006.01) |
| ***B61J 1/10*** | (2006.01) |
| ***E01B 7/00*** | (2006.01) |

(52) U.S. Cl.

CPC ..... *E01B 7/00* (2013.01)

(58) Field of Classification Search

CPC ..... B61J 1/00; B61J 1/10; B61J 1/12; E01B 5/00; E01B 5/02; E01B 5/18; E01B 7/00; E01B 7/02; E01B 7/10; E01B 7/20; E01B 7/28

See application file for complete search history.

(56) References Cited

U.S. PATENT DOCUMENTS

| | | | | |
|---|---|---|---|---|
| 3,783,793 A * | 1/1974 | Perrott | B61L 11/02 104/130.01 |
| 4,005,839 A * | 2/1977 | Frank | E01B 7/00 246/415 R |
| 4,862,807 A * | 9/1989 | Guadagno | B61B 1/00 104/130.07 |
| 8,577,585 B2 | 11/2013 | Atmur et al. | |
| 2012/0031298 A1 | 2/2012 | Kurahashi et al. | |

* cited by examiner

*Primary Examiner* — R. J. McCarry, Jr.
(74) *Attorney, Agent, or Firm* — Thompson Hine LLP

(57) ABSTRACT

A passive switch for a railway track is disclosed. A railway car is moveable along the railway track in a facing direction. The passive switch includes a first track section and a second track section. The first track section includes a first main track, a first diverging track, and a first guard rail. The first guard rail is shaped to guide a first wheel of the railway car from the first main track onto the first diverging track as the first wheel travels in the facing direction within the passive switch. The second track section includes a second main track and a second diverging track. The second main track is shaped to guide a second wheel of the railway car from the second main track onto the second diverging track.

19 Claims, 5 Drawing Sheets

PASSIVE SWITCH FOR A RAILWAY TRACK

FIELD

The disclosed system relates to a passive switch for a railway track and, more particularly, to a passive switch for a railway track that guides railway car wheels from a set of main tracks to a set of diverging tracks without moving parts.

BACKGROUND

Railroad switches enable a railway train to be guided from one track to another at a railway junction. The switch generally has a straight or through track and a diverging track. The switch may include a pair of linked tapering rails, which are commonly referred to as point rails. The point rails may be positioned between outer rails of the through track. The point rails may be actuated in a lateral direction and into one of two positions in order to determine whether a train should be led towards the straight path, or towards the diverging path.

Switches also have moving parts that actuate the point rails back and forth between the two positions in order to lead the train towards the through track or the diverging track. However, those skilled in the art will readily appreciate that moving parts typically require frequent inspections, maintenance, and replacement. For example, some moving switch elements include a lifetime of ten years/10,000 cycles maximum. Thus, in applications where switching may occur at rates of millions of cycles during the life of the track, replacement and maintenance of the moving parts within the track may become costly and time consuming. There are some partially passive switches currently available that only require one moving switch point or a sacrificial element to divert the train. However these partially passive switches and sacrificial elements also wear relatively quickly, and therefore need replacement as well. Thus, there exists a continuing need in the art for an effective railroad switch that overcomes the above mentioned problems.

SUMMARY

In one aspect, a passive switch for a railway track is disclosed. A railway car is moveable along the railway track in a facing direction. The passive switch includes a first track section and a second track section. The first track section includes a first main track, a first diverging track, and a first guard rail. The first guard rail is shaped to guide a first wheel of the railway car from the first main track onto the first diverging track as the first wheel travels in the facing direction within the passive switch. The second track section includes a second main track and a second diverging track. The second main track is shaped to guide a second wheel of the railway car from the second main track onto the second diverging track as the second wheel travels in the facing direction.

In another aspect, a method of switching a railway car from main tracks to diverging tracks when the railway car is traveling in a facing direction is disclosed. The method includes guiding a first wheel of the railway car from a first main track and onto a first diverging track by a first guard rail as the first wheel travels in the facing direction. The first guard rail is shaped to guide the first wheel. The method also includes guiding a second wheel of the railway car from a second main track and onto a second diverging track as the second wheel travels in the facing direction. The second main track is shaped to guide the second wheel.

Other objects and advantages of the disclosed method and system will be apparent from the following description, the accompanying drawings and the appended claims.

DETAILED DESCRIPTION

Figure 1:
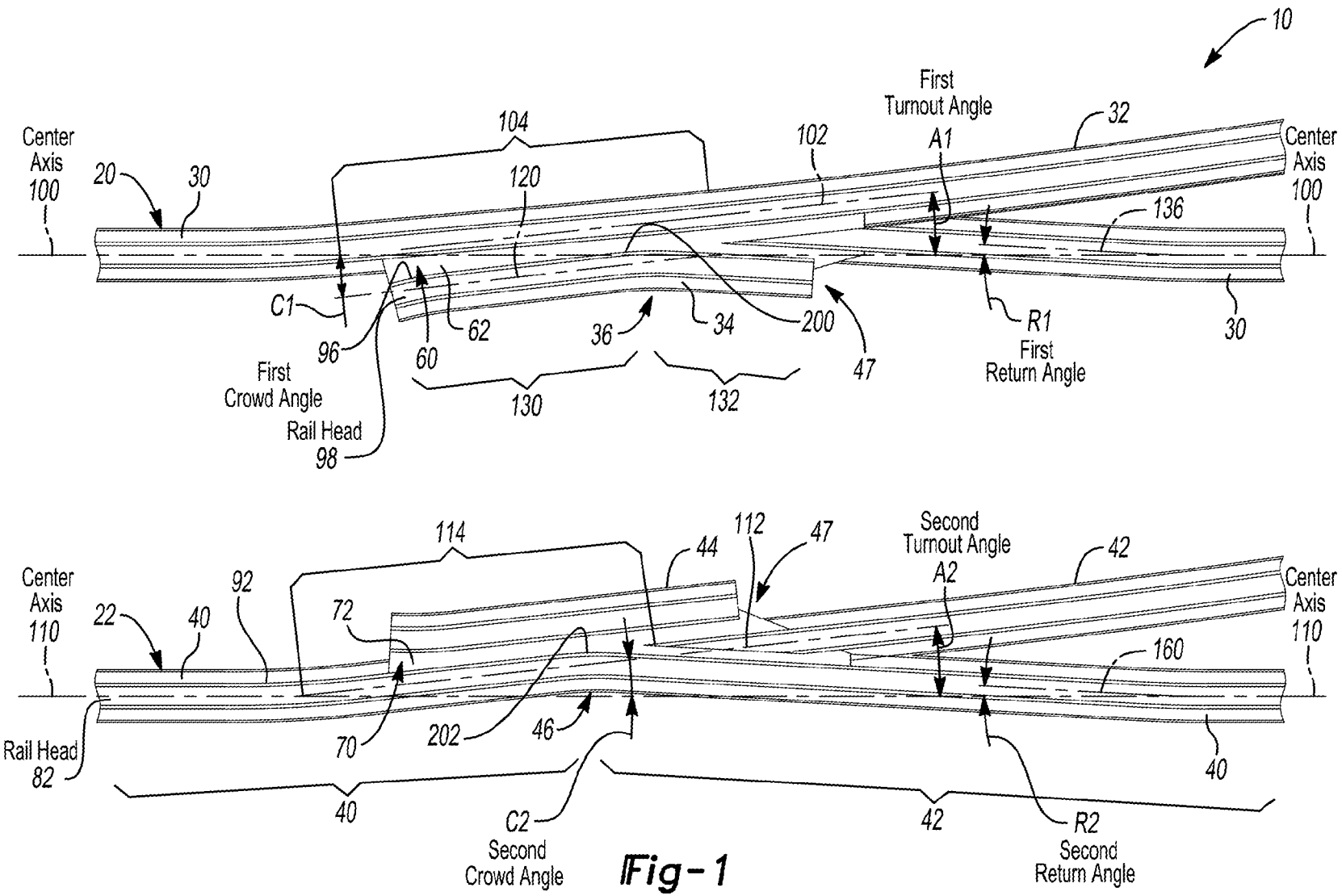
FIG. 1 is a top view of an exemplary passive switch located along a railway track, where the railway track includes a first track section and a second track section.

As shown in FIG. 1, the disclosed railway track 10 according to an aspect of the disclosure may include an first track section 20 and a second track section 22. The first track section 20 may include a through or main track 30, a diverging track 32, and a guard rail 34. The second track section 22 may include a main track 40, a diverging track 42, and a guard rail 44. The guard rail 34 of the first track section 20 may be curved at a bend or elbow 36. The shape of the guard rail 34 may be used to guide a railway car 50 (shown in FIG. 3) along the railway track 10, which is explained in greater detail below. Similarly, the main track 40 of the second track section 22 may be curved at a bend or elbow 46. Similar to the elbow 36 of the guard rail 34, the main track 40 may also be shaped to guide the railway car 50 (FIG. 3) along the railway track 10, which is also explained in greater detail below.

The first track section 20 and the second track section 22 may both be part of a passive switch 47 of the railway track 10. As explained in greater detail below, the passive switch 47 does not require moving parts to guide the railway car 50 along the railway track 10. Instead, the geometry or shape of the first track section 20 as well as the second track section 22 guides the railway car 50 along the railway track 10. It is to be understood that while the first track section 20 includes the guard rail 34 for guiding the railway car 50, in an alternative embodiment the guard rail 44 of the second track section 22 may be curved instead to guide the railway car 50. Additionally, the main track 30 of the first track section 20 may be curved instead to guide the railway car 50. In other words, the orientation of the first track 20 relative to the second track 22 as shown in the figures should not be limiting.

Figure 3:
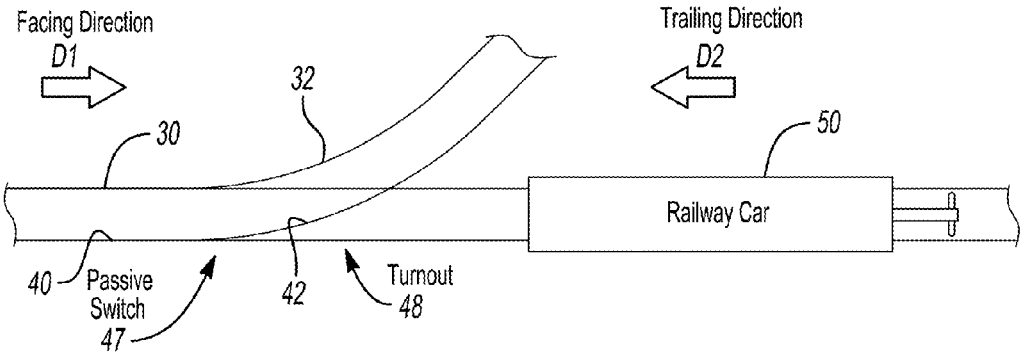
FIG. 3 is a schematic view of the railway track shown in FIG. 1, where a railway car is travelling along the railway track.

Referring to both FIGS. 1 and 3, the passive switch 47 guides the railway car 50 from the main tracks 30, 40 and onto the diverging tracks 32, 42 as the railway car 50 travels in a facing direction D1 along the railway track 10. The passive switch 47 also allows the railway car 50 to stay on the main tracks 30, 40 when the railway car 50 travels in a trailing direction D2, which is opposite to the facing direction, along the railway track 10. Furthermore, the passive switch 47 may also guide the railway car 50 from the diverging tracks 32, 42 and onto the main tracks 30, 40 as the railway car 50 is travelling in the trailing direction D2 along the railway track 10. As seen in FIG. 3, the passive switch 47 is positioned upstream of a turnout 48 of the railway track 10 when viewed along the facing direction D1.

Turning back to FIG. 1, the first track section 20 and the second track section 22 each include respective raised sections, which are referred to as flooded sections. Specifically, the first track section 20 includes a flooded section 60 and the second track section 22 includes a flooded section 70. The flooded section 60 of the first track section 20 may include a raised or elevated surface 62 disposed between the main track 30 and the guard rail 34. A portion of the flooded section 60 of the first track section 20 may also be located between the main track 30 and the diverging track 32. Similarly, the flooded section 70 of the second track section 22 may also include a raised or elevated surface 72 disposed between the main track 40 and the guard rail 44. A portion of the flooded section 70 may also be located between the main track 40 and the diverging track 42.

Figure 2:
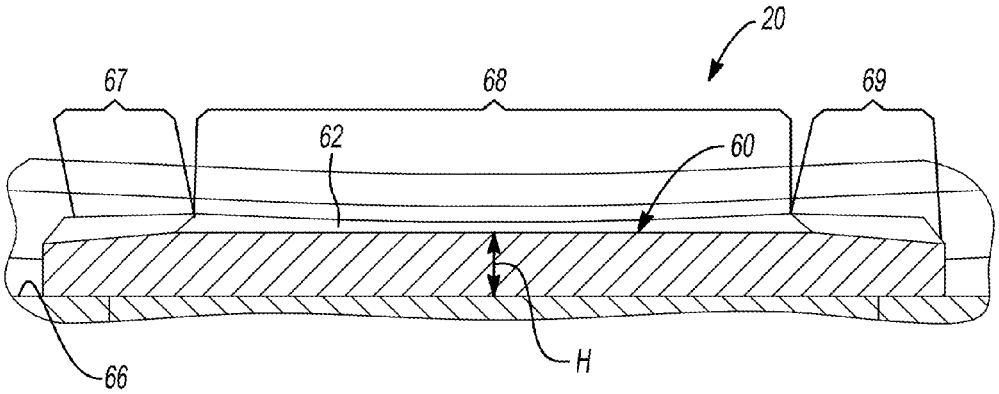
FIG. 2 is a cross-sectioned view of the first track section shown in FIG. 1.

Turning to FIG. 2, a cross-sectioned view of the first track section 20 taken along the flooded section 60 is shown. The flooded section 60 represents a raised or elevated section of track having a height H. The height H of the flooded section 60 may be measured between a bottom surface 66 of the first track section 20 and the elevated surface 62 of the flooded section 60. The flooded section 60 may also include a ramped configuration. As seen in FIG. 2, the flooded section 60 may include a first ramped section 67 of increasing height, a straight or level section 68, and a second ramped surface 69 of decreasing height. Although only the flooded section 60 of the first track section 20 is illustrated, it is to be understood that the flooded section 70 of the second track section 22 (FIG. 1) also includes similar geometry as well.

Figure 4:
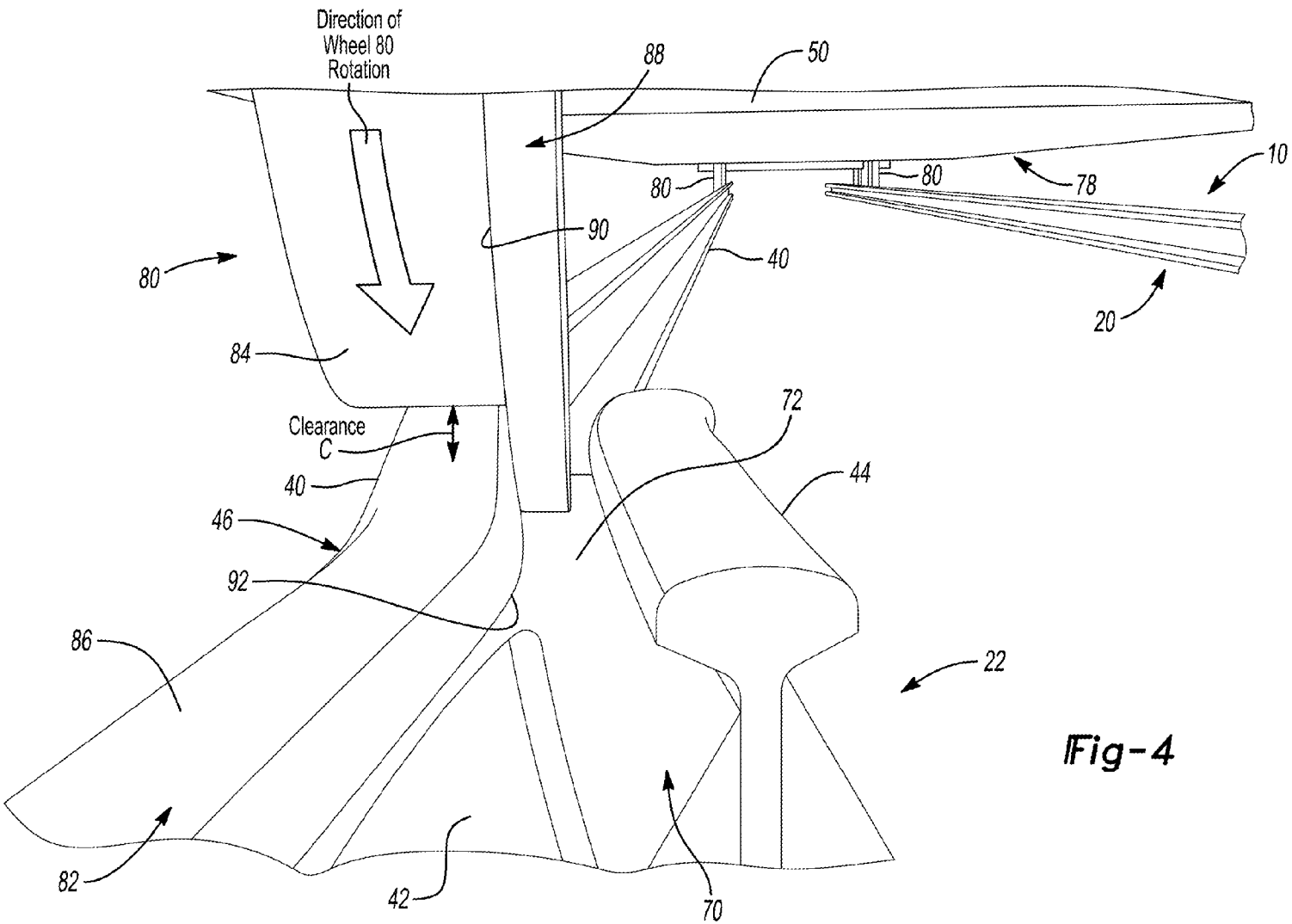
FIG. 4 is an enlarged view illustrating a wheel of the railway car traveling within the passive switch.

Both the flooded sections 60, 70 may be used to raise respective wheels of the railway car 50 as the railway car 50 travels along the passive switch 47. Turning to FIG. 4, one of the railway car wheels 80 of the railway car 50 is illustrated travelling along the second track section 22, at the flooded section 70. Those skilled in the art will readily appreciate that when the wheel 80 is not rolling along the flooded section 70, a rolling surface 84 of the railway car wheel 80 may contact and roll against a first surface 86 of a rail head 82 of the main track 40. However, as seen in FIG. 4, once the wheel 80 travels within the flooded section 70 of the second track section 22, the rolling surface 84 of the wheel 80 may deflect away from the rail head 82 of the main track 40 such that there is a clearance C between the rolling surface 84 of the wheel 80 and the rail head 82 of the main track 40.

Continuing to refer to FIG. 4, when the wheel 80 travels within the flooded section 70 of the second track section 22, a flange 88 of the wheel 80 makes contact with and rolls against the elevated surface 72 of the flooded section 70. Thus, when the wheel 80 rolls within the flooded section 70, this travel of the wheel 80 may be referred to as flange riding travel. In other words, the wheel 80 as seen in FIG. 4 is flange riding because the flange 88 of the wheel 80 rolls against the elevated surface 72 of the flooded section 70.

When the wheel 80 is flange riding, an outermost side surface 90 of the flange 88 of the wheel 80 may abut against an innermost side surface 92 of the rail head 82 of the main track 40. The abutment between the wheel 80 and the rail head 82 may position and guide the railway car 50 along the railway track 10. Specifically, the main track 40 is bent at the elbow 46 in order to guide the wheel 80 along the railway track 10, which is described in greater detail below. The guide rail 44 of the first track section 20 may be used to ensure that the wheel 80 does not derail from the second track section 22 when the wheel 80 is flange riding. Those skilled in the art will readily appreciate that although only the second track section 22 is illustrated in FIG. 4, another wheel 80 on an opposite side 78 of the railway car 50 may also be flange riding when rolling within the flooded section 60 (FIG. 1) of the first track section 20, which is explained below.

Figure 5:
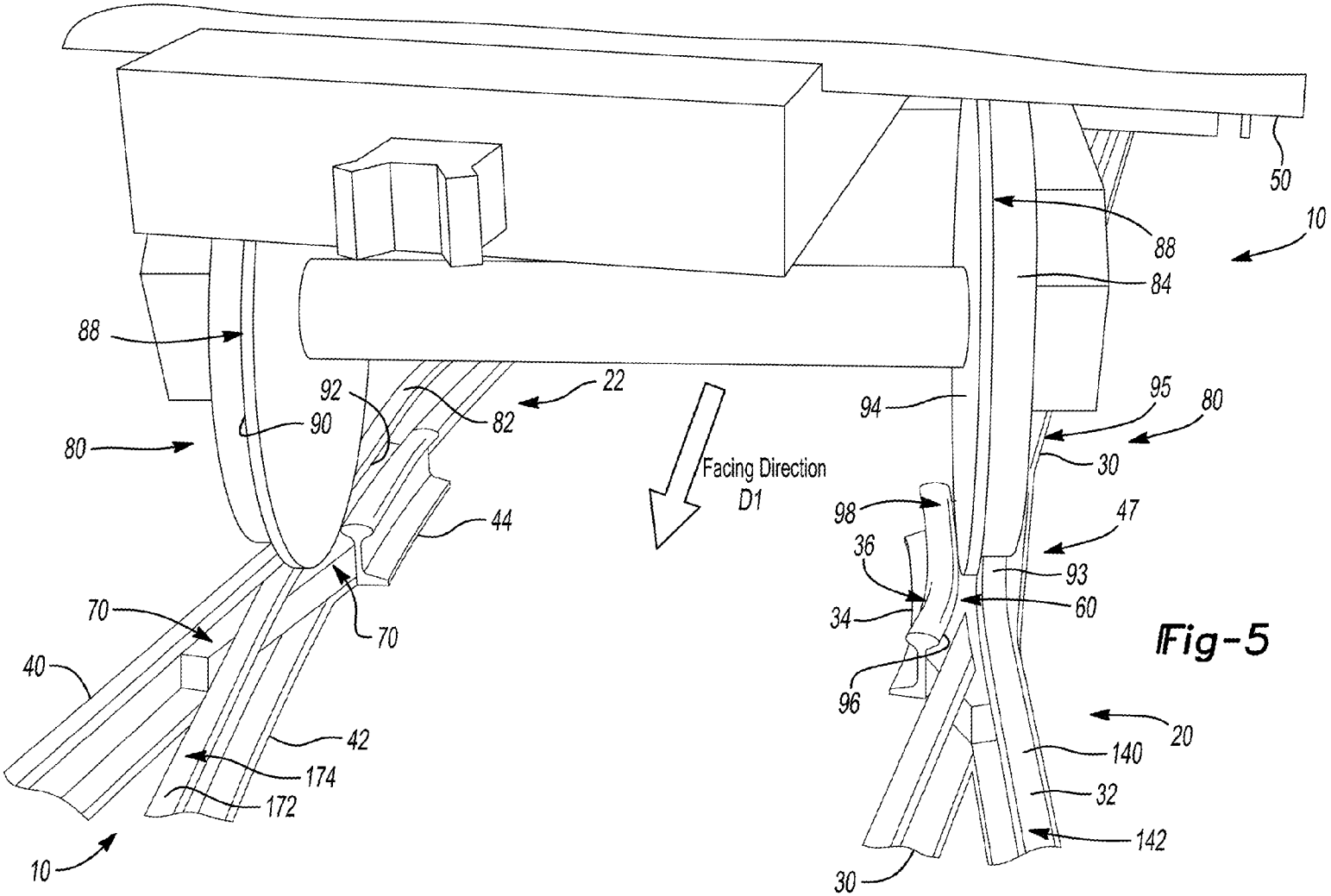
FIG. 5 is a perspective view of two wheels of the railway car being guided through the passive switch as the railway car moves in a facing direction.

Turning now to FIG. 5, an illustration of the railway car 50 entering the passive switch 47 while travelling in the facing direction D1 is shown. As seen in FIG. 5, the flange 88 of one of the wheels 80 of the railway car 50 also rolls within the flooded section 60 of the first track section 20. As explained above, when the wheel 80 is flange riding within the flooded section 60, the rolling surface 84 of the wheel 80 may no longer make contact with a first surface 93 of a rail head 95 of the main track 30. Moreover, when the wheel 80 is flange riding within the flooded section 60, an innermost side surface 94 of the flange 88 of the wheel 80 may abut against an outermost side surface 96 of a rail head 98 of the guard rail 44. The abutment between the wheel 80 and the rail head 98 of the guard rail 44 may also position and guide the railway car 50 along the railway track 10. Specifically, the guard rail 44 may be bent at the elbow 36 in order to guide the wheel 80 along the railway track 10, which is described in greater detail below.

Turning back to FIG. 1, both the first track section 20 and the second track section 22 each define corresponding initial turnout angles. Specifically, the first track section 20 defines a first turnout angle A1. The first turnout angle A1 may be defined between the main track 30 and the diverging track 32. The first track section 20 defines a substantially straight center axis 100. As seen in FIG. 1, the center axis 100 extends in a substantially longitudinal direction along a portion of the main track 30.

The first track section 20 also defines a second axis 102. The second axis 102 is aligned with a portion of the main track 30 and the diverging track 32. Specifically, the second axis 102 is aligned with the main track 30 at a curved section 104. The curved section 104 represents where the main track 30 bends or curves in a direction away from the center axis 100 of the first track section 20, and transitions into the diverging track 32. The first turnout angle A1 is measured between the center axis 100 and the second axis 102 of the first track section 20.

Similarly, the second track section 22 defines a second turnout angle A2. The second turnout angle A2 may be defined between the main track 40 and the diverging track 42. The second track section 22 defines a substantially straight center axis 110. Specifically, the center axis 110 extends in a substantially longitudinal direction along a portion of the main track section 40. As seen in FIG. 1, even as the main track 40 bends at the elbow 46, the center axis 110 still remains substantially straight. The second track section 22 defines a second axis 112. The second axis 112 of the second track section 22 is aligned with a portion of the main track 40 as well as the diverging track 42. Specifically, the second axis 112 is aligned with a curved section 114 of the main track 40. The curved section 114 represents where the main track 40 bends or curves at the elbow 46 in a direction away from the center axis 110, and transitions into the diverging track 42. The second turnout angle A2 is measured between the center axis 110 and the second axis 112 of the second track section 22.

It is to be understood that the first turnout angle A1 and the second turnout angle A2 may be substantially identical in dimension with one another. For example, in one embodiment the first turnout angle A1 and the second turnout angle A2 may be standard size turnout angles (e.g., a number 4 turnout, or a number 6 turnout, etc.).

Referring to FIGS. 1 and 3, the first track section 20 and the second track section 22 may both be curved or bent in order to guide rolling stock (i.e., the railway car 50) travelling along the main tracks 30, 40 in the facing direction D1 towards the diverging tracks 32, 42. Specifically, as seen in FIG. 1, a first portion 130 of the guard rail 34 of the first track section 20 may be curved at a first crowd angle C1. A remaining or second portion 132 of the guard rail 34 may be curved or bent at a first return angle R1. The guard rail 34 is bent at the elbow 36 between the first crowd angle C1 and the first return angle R1 to create a substantially V-shaped profile.

As seen in FIG. 1, the first crowd angle C1 is measured between the center axis 100 of the first track section 20 and a curvature line 120 of the guard rail 34. Specifically, the curvature line 120 is aligned with the guard rail 34 at the first portion 130. The first return angle R1 is measured between the center axis 100 of the main track 30 and a center axis 136 of the main track 30. Specifically, the center axis 136 is aligned with a curved portion of the main track 30 that diverges towards and re-aligns with the center axis 100 of the first track section 20.

The first crowd angle C1 is at least substantially equal to the first turnout angle A1 of the first track section 20. However, it is to be understood that the first crowd angle C1 is less than twice the first turnout angle A1 of the first track section 20. The first return angle R1 may be any dimension that allows for the wheel 80 of the railway car 50 to be guided towards the elbow 36 of the guard rail 34 as the railway car 50 travels in the trailing direction D2, which is explained in greater detail below.

Referring to FIGS. 1 and 5, when one of the wheels 80 of the railway car 50 is travelling in the facing direction D1 and enters the flooded section 60 of the first track section 20, the wheel 80 becomes flange riding. It is to be understood that the guard rail 34 is shaped to guide the wheel 80 from the main track 30 onto the diverging track 32 as the railway car 50 travels in the facing direction D1. The travel of the wheel 80 from the main track 30 onto the diverging track 32 is described in detail below.

Continuing to referring to FIGS. 1 and 5, the innermost side surface 94 of the flange 88 of the wheel 80 abuts against the outermost side surface 96 of the rail head 98 of the guard rail 34 at the first crowd angle C1 when the wheel 80 is flange riding. Once the outermost side surface 96 of the guard rail 34 makes contact with the flange 88 of the wheel 80, the guard rail 34 may guide the wheel 80 through the flooded section 60 of the first track section 20. Specifically, the innermost side surface 94 of the flange 88 of the wheel 80 abuts against the outermost side surface 96 of the guard rail 34 at the first crowd angle C1. When the wheel 80 travels in the facing direction D1, the crowd angle C1 guides the wheel 80 along the curved section 104 of the main track 30. As best seen in FIG. 1, the curved section 104 of the main track 30 eventually transitions into the diverging track 32. As a result, once the wheel 80 exits the flooded section 60 of the first track section 20 and is no longer flange riding, the wheel 80 may now roll along the diverging track 32. In particular, the rolling surface 84 of the wheel 80 may contact and roll against a first surface 140 of a rail head 142 of the diverging track 32 (seen in FIG. 5).

Figure 6:
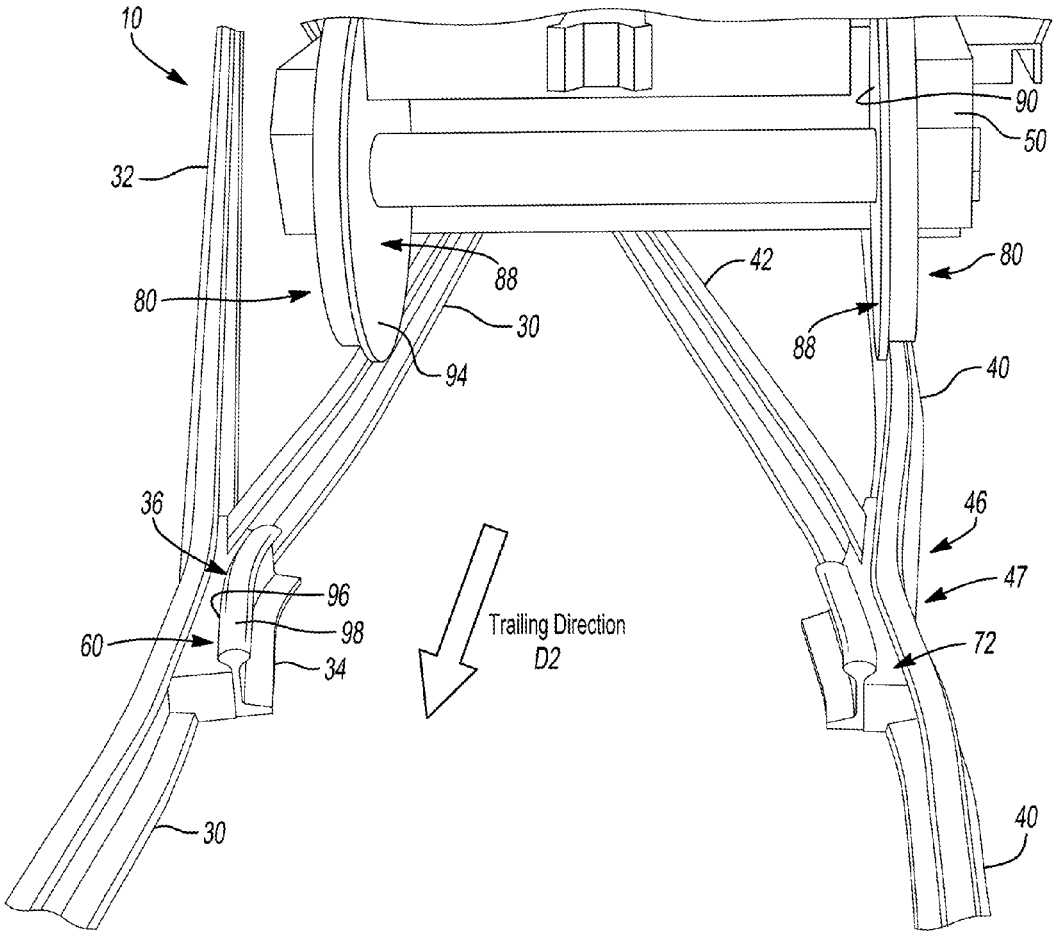
FIG. 6 is a view of two wheels of the railway car being guided through the passive switch as the railway car moves in a trailing direction.

The passive switch 47 also allows for railway cars 50 travelling in the trailing direction D2 to remain on the main tracks 30, 40. FIG. 6 is an illustration of the railway car 50 travelling in the trailing direction D2 along the main tracks 30, 40, and towards the passive switch 47. Referring to FIGS. 1, 3 and 6, the passive switch 47 may also guide the railway car 50 along the main track 30. Specifically, as one of the wheels 80 of the railway car 50 rolls along the main track 30 and into the flooded section 60 of the first track section 20 to become flange riding, the outermost side surface 96 of the rail head 98 of the guard rail 34 abuts against the innermost side surface 94 of the flange 88 of the wheel 80 at the first return angle R1.

The first return angle R1 is angled to provide guidance to the wheel 80, and directs the wheel 80 towards an apex 200 of the elbow 36 of the guard rail 34 (the apex 200 is shown in FIG. 1). The guard rail 34 transitions from the first return angle R1 and into the first crowd angle C1 at the apex 200 of the elbow 36 of the guard rail 34. Once the wheel 80 rolls over the apex 200 of the elbow 36, the wheel 80 may continue to contact and roll against the outermost side surface 96 of the guard rail 34 along the first crowd angle C1. Thus, once the wheel 80 exits the flooded section 60 of the first track section 20 and is no longer flange riding, the wheel 80 continues to roll along the main track 30.

Referring to FIGS. 1, 3 and 5, the passive switch 47 may also guide the railway car 50 travelling along the diverging track 32 and onto the main track 30 as the railway car 50 travels in the trailing direction D2. Specifically, one of the wheels 80 of the railway car 50 may roll along the diverging track 32 in the trailing direction D2 and enter the flooded section 60 of the first track section 20 to become flange riding. Eventually, the innermost side surface 94 of the flange 88 of the wheel 80 makes contact with and abuts against the outermost side surface 96 of the rail head 98 of the guard rail 34 at the first crowd angle C1. As the wheel 80 travels in the trailing direction D2, the crowd angle C1 of the guard rail 34 guides the wheel 80 along the curved section 104 of the main track 30. As a result, once the wheel 80 exits the flooded section 60 of the first track section 20 and is no longer flange riding, the wheel 80 may roll along the main track 30.

Turning back to FIG. 1, the second track section 22 also includes a similar configuration for guiding the railway car 50 (FIG. 3) through the passive switch 47. However, unlike the first track section 20, the main track 40 may be bent instead of the guard rail 34. Specifically, as seen in FIG. 1, the main track 40 of the second track section 22 may be bent or curved at a second crowd angle C2 as well as at a second return angle R2. The main track 40 may include a substantially V-shaped profile, which is similar to the V-shaped profile of the guard rail 34. As explained in greater detail below, the main track 40 may also be curved or bent in a direction that corresponds with the curvature of the guard rail 34 in order to provide guidance to the wheels 80 of the railway car 50 (FIG. 4) when the wheels 80 are flange riding.

As seen in FIG. 1, the second crowd angle C2 is measured between the center axis 110 of the second track section 22 and the second axis 112 of the second track section 22. The second crowd angle C2 is at least substantially equal to the second turnout angle A2. The second return angle R2 is measured between the center axis 110 of the second track section 22 and a center axis 160 of the main track 40. The center axis 160 is aligned with a curved portion of the main track 40 that diverges towards and re-aligns with the center axis 110 of the second track section 22. The second return angle R2 may be substantially equal in dimension with the first return angle R1 of the first track section 20. The second return angle R2 may include any dimension that allows for the wheel 80 of the railway car 50 to be guided towards the elbow 46 of the main track 40 as the railway car 50 travels in the trailing direction D2, which is explained in greater detail below.

Referring to FIGS. 1 and 5, as the wheel 80 becomes flange riding within the flooded section 70 of the second track section 22, the main track 40 may make contact with the wheel 80. Specifically, the outermost side surface 90 of the flange 88 of the wheel 80 abuts against the innermost side surface 92 of the rail head 82 of the main track 40. The main track 30 is bent at the elbow 46 (seen in FIG. 1), and is shaped to guide the wheel 80 of the railway car 50 from the main track 40 and onto the diverging track 42 as the wheel 80 travels in the facing direction D1, and is described in detail below.

Continuing to refer to FIGS. 1 and 5, the outermost side surface 90 of the flange 88 of the wheel 80 abuts against the innermost side surface 92 of the rail head 82 of the main track 40 at the second crowd angle C2 when the wheel 80 is flange riding. As the wheel 80 travels in the facing direction D1, the second crowd angle C2 guides the wheel 80 along the curved section 114 of the main track 40. The curved section 114 of the main track 40 eventually transitions into the diverging track 42. As a result, once the wheel 80 exits the flooded section 70 of the first track section 20 and is no longer flange riding, the wheel 80 rolls along the diverging track 42. In particular, the rolling surface 84 of the wheel 80 may contact and roll against a first surface 172 of a rail head 174 (seen in FIG. 5) of the diverging track 42 once the wheel 50 exits the flooded section 70.

Referring to FIGS. 1, 3 and 6, the passive switch 47 also allows for railway car 50 travelling in the trailing direction D2 to remain on the main track 40. Specifically, as the wheel 80 of the railway car 50 rolls along the main track 40 in the trailing direction D2 and enters the flooded section 70 of the second track section 22 to become flange riding, the outermost side surface 90 of the flange 88 of the wheel 80 abuts against the innermost side surface 92 of the rail head 82 of the main track 40 at the second return angle R2. The second return angle R2 is angled to provide guidance to the wheel 80, and directs the wheel 80 towards an apex 202 of the elbow 46 of the main track 40 (the apex 202 is shown in FIG. 1). The main track 40 transitions from the second return angle R2 and into the second crowd angle C2 at the apex 202 of the elbow 46 of the main track 40. Once the wheel 80 rolls over the apex 202 of the elbow 46, the wheel 80 may continue to contact and roll against the innermost side surface 92 of the main track 40 along the second crowd angle C2. The second crowd angle C2 of the main track 40 continues to guide the wheel 80 along the main track 40. As a result, once the wheel 80 exits the flooded section 70 of the second track section 22 and is no longer flange riding, the wheel 80 continues to roll along the main track 40.

Referring to FIGS. 1, 3 and 6, the passive switch 47 may also guide the railway car 50 from the diverging track 42 and onto the main track 40 when the railway car 50 is travelling in the trailing direction D2. Specifically, the wheel 80 rolls along the diverging track 42 and into the flooded section 70 of the second track section 22 to become flange riding. The wheel 80 may continue to roll within the flooded section 70. Eventually, the outermost side surface 90 of the flange 88 of the wheel 80 makes contact with and abuts against the innermost side surface 92 of the rail head 82 of the main track 40 at the second crowd angle C2 (seen in FIG. 1). The second crowd angle C2 of the main track 40 guides the wheel 80 along the curved section 114 of the main track 40. As a result, once the wheel 80 exits the flooded section 70 of the second track section 22 and is no longer flange riding, the wheel 80 may now roll along the main track 40.

Referring generally to the figures, it is to be understood that the disclosed passive switch does not require moving parts that require actuation. Thus, it is to be understood that the disclosed passive switch provides various advantages and benefits when compared to a traditional railway switch, which includes numerous moving parts. In particular, since the disclosed passive switch does not include moving parts, the disclosed passive switch may last the lifetime of the railway tracks. Moreover, the disclosed passive switch also does not generally require periodic replacement and maintenance, unlike most railway switches that are currently available.

While the forms of apparatus and methods herein described constitute preferred aspects of this disclosure, it is to be understood that the disclosure is not limited to these precise forms of apparatus and methods, and the changes may be made therein without departing from the scope of the disclosure.

What is claimed is:

1. A passive switch for a railway track, wherein a railway car is moveable along the railway track in a facing direction, the passive switch comprising:

a first track section including a first main track, a first diverging track, and a first guard rail, wherein the first guard rail is shaped to guide a first wheel of the railway car from the first main track onto the first diverging track as the first wheel travels in the facing direction within the passive switch, and wherein the first flooded section represents a raised section of the railway track that raises the first wheel of the railway car as the railway car moves along the railway track, the first flooded section located between the first guard rail and the first main track, and between the first guard rail and the first diverging track; and a second track section including a second main track and a second diverging track, wherein the second main track is shaped to guide a second wheel of the railway car from the second main track onto the second diverging track as the second wheel travels in the facing direction within the passive switch.

2. The passive switch of claim 1, wherein a first turnout angle is defined between the first main track and the first diverging track.

3. The passive switch of claim 2, wherein a first portion of the first guard rail is bent at a first crowd angle, and wherein the first crowd angle is at least substantially equal to the first turnout angle.

4. The passive switch of claim 3, wherein the first crowd angle is less than twice the first turnout angle.

5. The passive switch of claim 3, wherein a second portion of the first guard rail is bent at a first return angle.

6. The passive switch of claim 1, wherein a second turnout angle is defined between the second main track and the second diverging track.

7. The passive switch of claim 6, wherein the second main track of the second track section is curved at a second crowd angle.

8. The passive switch of claim 7, wherein the second crowd angle is at least substantially equal to the second turnout angle.

9. The passive switch of claim 7, wherein the second main track is bent at a second return angle, wherein the second return angle is measured between a center axis of the second track section and a center axis of the second diverging track.

10. The passive switch of claim 9, wherein the center axis of the second track section extends in a substantially longitudinal direction along a portion of the second track section.

11. The passive switch of claim 1, wherein the second track section includes a second guard rail.

12. The passive switch of claim 11, wherein the second track section includes a second flooded section disposed between the second main track and the second guard rail, and between the second main track and the second diverging track.

13. A method of switching a railway car from main tracks to diverging tracks when the railway car is traveling in a facing direction, the method comprising:

guiding a first wheel of the railway car from a first main track and onto a first diverging track by a first guard rail as the first wheel travels in the facing direction, wherein the first guard rail is shaped to guide the first wheel through a first flooded section, wherein the first flooded section represents a raised section of the railway track that raises the first wheel of the railway car as the railway car moves along the railway track, and wherein the first flooded section is located between the first guard rail and the first main track, and between the first guard rail and the first diverging track; and guiding a second wheel of the railway car from a second main track and onto a second diverging track as the second wheel travels in the facing direction, wherein the second main track is shaped to guide the second wheel through a second flooded section, wherein the second flooded section represents a raised section of the railway track that raises the second wheel of the railway car as the railway car moves along the railway track, and wherein the second flooded section is located between the second guard rail and the second main track, and between the first guard rail and the first diverging track.

14. The method of claim 13, comprising guiding the first wheel of the railway car from the first diverging track and onto the first main track by the first guard rail as the first wheel travels in a trailing direction.

15. The method of claim 13, comprising guiding the second wheel of the railway car from the second diverging track and onto the second main track by the second main track as the second wheel travels in a trailing direction.

16. The method of claim 13, wherein a first turnout angle is defined between the first main track and the first diverging track.

17. The method of claim 16, wherein a first portion of the first guard rail is bent at a first crowd angle, and wherein the first crowd angle is at least substantially equal to the first turnout angle and is less than twice the first turnout angle.

18. The method of claim 13, wherein a second turnout angle is defined between the second main track and the second diverging track.

19. The method of claim 18, wherein the second main track of the second track section is curved at a second crowd angle that is at least substantially equal to the second turnout angle.

* * * * *